US006649316B2

(12) United States Patent
Baker et al.

(10) Patent No.: US 6,649,316 B2
(45) Date of Patent: Nov. 18, 2003

(54) PHASE CHANGE DEVELOPER FOR LIQUID ELECTROPHOTOGRAPHY

(75) Inventors: James A. Baker, Hudson, WI (US); Julie Y. Qian, Woodbury, MN (US); Gay L. Herman, Cottage Grove, MN (US)

(73) Assignee: Samsung Electronics Co. Ltd, Suwon (KR)

( * ) Notice: Subject to any disclaimer, the term of this patent is extended or adjusted under 35 U.S.C. 154(b) by 0 days.

(21) Appl. No.: 10/127,062

(22) Filed: Apr. 19, 2002

(65) Prior Publication Data

US 2002/0197552 A1 Dec. 26, 2002

Related U.S. Application Data

(60) Provisional application No. 60/285,184, filed on Apr. 20, 2001.

(51) Int. Cl.[7] ..... G03G 9/135

(52) U.S. Cl. ..... 430/114; 430/115; 430/124; 430/126

(58) Field of Search ..... 430/114, 115, 430/124, 126

(56) References Cited

U.S. PATENT DOCUMENTS

| | | | | |
|---|---|---|---|---|
| 3,247,007 A | | 4/1966 | Oliphant | 117/37 |
| 3,795,530 A | | 3/1974 | Gundlach | 117/17.5 |
| 4,557,991 A | | 12/1985 | Takagiwa et al. | 430/109 |
| 4,659,640 A | | 4/1987 | Santilli | 430/119 |
| 5,075,735 A | | 12/1991 | Tsuchiya et al. | 355/326 |
| 5,229,235 A | | 7/1993 | Watanabe et al. | 430/45 |
| 5,232,812 A | | 8/1993 | Morrison et al. | 430/124 |
| 5,364,726 A | | 11/1994 | Morrison et al. | 430/115 |
| 5,368,972 A | | 11/1994 | Yamashita et al. | 430/137 |
| 5,395,724 A | | 3/1995 | Morrison et al. | 430/115 |
| 5,397,673 A | | 3/1995 | Watson et al. | 430/126 |
| 5,635,325 A | | 6/1997 | Inaba et al. | 430/106 |
| 5,783,350 A | | 7/1998 | Matsuoka et al. | 430/116 |
| 5,886,067 A | | 3/1999 | Li et al. | 523/201 |
| 5,935,751 A | | 8/1999 | Matsuoka et al. | 430/110 |
| 6,103,781 A | | 8/2000 | Li et al. | 523/201 |
| 6,110,635 A | | 8/2000 | Urata et al. | 430/137 |
| 6,153,347 A | | 11/2000 | Kabai et al. | 430/110 |
| 6,221,551 B1 | * | 4/2001 | Bonsignore et al. | 430/114 |

FOREIGN PATENT DOCUMENTS

| | | | |
|---|---|---|---|
| EP | 0 348 844 B1 | 10/1994 | G03G/13/06 |
| EP | 0 605 108 B1 | 5/1998 | G03G/9/125 |

* cited by examiner

*Primary Examiner*—John Goodrow
(74) *Attorney, Agent, or Firm*—Mark A. Litman & Assoc. P.A.

(57) ABSTRACT

This invention relates to a phase change developer comprising:

(a) a carrier having a Kauri-butanol number less than 30; and (b) an organosol comprising a graft (co)polymeric steric stabilizer covalently bonded to a thermoplastic (co) polymeric core that is insoluble in said carrier, and said (co)polymeric steric stabilizer comprises a crystallizing polymeric moiety that independently and reversibly crystallizes at or above 30° C., wherein said phase change developer has a melting point at or above 22° C.

17 Claims, 2 Drawing Sheets

PHASE CHANGE DEVELOPER FOR LIQUID ELECTROPHOTOGRAPHY

This application claims the benefit of Provisional Application No. 60/285,184, filed Apr. 20, 2001.

BACKGROUND OF THE INVENTION

1. Field of the Invention

This invention relates generally to a phase change developer for liquid electrophotography, and more particularly to a phase change developer that contains a crystallizable polymeric binder resin and the phase change developer reversibly changes from solid phase to liquid phase at or above 22° C.

2. Background of the Art

In electrophotography, a photoreceptor in the form of a plate, sheet, belt, or drum having an electrically insulating photoconductive element on an electrically conductive substrate is imaged by first uniformly electrostatically charging the surface of the photoconductive element, and then exposing the charged surface to a pattern of light. The light exposure selectively dissipates the charge in the illuminated areas, thereby forming a pattern of charged and uncharged areas (i.e., an electrostatic latent image). A liquid or dry developer is then deposited in either the charged or uncharged areas to create a toned image on the surface of the photoconductive element. The resulting visible image can be fixed to the photoreceptor surface or transferred to a surface of a suitable receiving medium such as sheets of material, including, for example, paper, transparency, metal, metal coated substrates, composites and the like. The imaging process can be repeated many times on the reusable photoconductive element.

In some electrophotographic imaging systems, the latent images are formed and developed on top of one another in a common imaging region of the photoreceptor. The latent images can also be formed and developed in multiple passes of the photoreceptor around a continuous transport path (i.e., a multi-pass system). Alternatively, the latent images can be formed and developed in a single pass of the photoreceptor around the continuous transport path. A single-pass system enables the multi-color images to be assembled at extremely high speeds relative to the multi-pass system. At each color development station, color developers are applied to the photoreceptor belt, for example, by electrically biased rotating developer rolls.

Image developing methods can be classified into liquid type developing and dry type developing. The dry type method uses dry developers and the wet type method uses liquid developers.

Dry developers are generally prepared by mixing and dispersing colorant particles and a charge director into a thermoplastic binder resin, followed by milling or micropulverization. The resulted developer particle sizes are generally in the range of about 4 to 10 microns, which size particles are readily carried by air movement. For this reason, if the fine powders of a dry developer are scattered, they pose an environmental problem. However, dry particles provide excellent ease of handling and stability for the developer particles.

On the other hand, liquid developers are prepared by dispersing colorant particles, a charge director, and a binder in an insulating liquid (i.e., a carrier liquid). Liquid developer based imaging systems incorporate features similar to those of dry developer based system. However, liquid developer particles are significantly smaller than dry developer particles. Because of their small particle size, ranging from 3 microns to submicron size, liquid developers are capable of producing very high resolution images.

The major problems of liquid developers are the emission of the liquid carrier from liquid developers to the environment during the drying and transfer process due to inefficient solvent recovery system; the need to dispose the waste liquids; and inconvenience since their handling is difficult and frequent maintenance is required for maintaining stable image formation.

It would be desirable to provide a novel phase change developer which provides the advantages of both the dry and liquid developers. The phase change developer must be stable, easy to be handled, pose no environmental problems such as solvent emission and dry toner spill; and provide high resolution images.

The phase change developer can reversibly change from a solid phase to a liquid phase at its melting point or crystallization temperature. The phase change developer is a solid in storage and before image development. During image development, the phase change developer melts at a temperature above its melting point to form a liquid developer which then undergoes a liquid electrophotographic process to produce toned images.

Some phase change developers for liquid electrophotography have been mentioned in U.S. patents. U.S. Pat. No. 5,229,235 discloses a phase change developer comprising a colorant and an insulating organic material having a melting point not lower than 30° C. The organic material is selected from the group of normal paraffins with 19 to 60 carbons, waxes, and crystalline high molecular material. The preferred organic materials are paraffins and waxes.

U.S. Pat. No. 5,783,350 claims a phase change developer comprising a colorant, a thermoplastic resin, and an insulating carrier. The insulating carrier is selected from the group of a branched or linear aliphatic hydrocarbon paraffin or wax, a crystalline polymeric resin having a low molecular weight and a mixture of the foregoing. Among these, particularly preferred is a paraffin consisting primarily of an alkane which has a definite melting point and has a low viscosity after fusion.

U.S. Pat. No. 5,886,067 claims a liquid developer comprising a carrier liquid, a charge director, and an organosol having a (co)polymeric steric stabilizer covalently bonded to a thermoplastic (co)polymeric core and said (co)polymeric steric stabilizer comprises a crystallizing polymeric moiety that independently and reversibly crystallizes at or above 22° C.

SUMMARY OF THE INVENTION

This invention features a phase change developer that includes:

(a) a carrier having a Kauri-butanol number less than 30; and an organosol comprising a graft (co)polymeric steric stabilizer covalently bonded to a thermoplastic (co)polymeric core that is insoluble in said carrier, and said (co)polymeric steric stabilizer comprises a crystallizing polymeric moiety (e.g., located on a side-chain or main-chain) that independently (that is, this moiety may crystallize even if other moieties in the stabilizer do not crystallize) and reversibly (that is, the moiety, after crystallization, can be rendered amorphous by physical processes) crystallizes at or above 30° C., wherein said phase change developer has a melting point, exudation temperature, flow temperature or melt temperature at or above 22° C.

The phase change developers of the present invention will be described primarily with respect to electrophotographic office printing; however, it is to be understood that these phase change developers are not so limited in their utility and may also be employed in other imaging processes, other printing processes, or other developer transfer processes, such as high speed printing presses, photocopying apparatus, microfilm reproduction devices, facsimile printing, ink jet printer, instrument recording devices, and the like.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
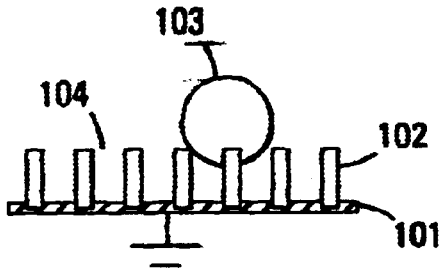
FIG. 1 is a diagrammatic illustration of a developer storage and delivery system wherein a phase change developer is placed on top of discrete conductive heating elements.

The invention features a phase change developer composition comprising a colorant and a crystalline polymeric binder resin with a melting point higher than 30° C. dispersed in a carrier having a Kauri-Butanol (KB) number less than 30 (Alternatively, the polarity of adjuvants may be measured using the Kauri-butanol value for estimation of solvent power. The phase change developer composition is resistant to both aggregation and sedimentation and is capable of rapid film formation (rapid self-fixing), which is particularly useful in electrophotographic, ionographic or electrostatic imaging and other conventional printing processes.

"Kauri-Butanol" refers to an ASTM Test Method D1133-54T. The Kauri-Butanol Number (KB) is a measure of the tolerance of a standard solution of kauri resin in 1-butanol to an added hydrocarbon diluent and is measured as the volume in milliliters (mL) at 25° C. of the solvent required to produce a certain defined degree of turbidity when added to 20 g of a standard kauri-l-butanol solution. Standard values are toluene (KB=105) and 75% by volume of heptane with 25% by volume toluene (KB=40). Additional references to Kauri-butanol values include the protocol described in ASTM Standard: Designation 1133-86. However, the scope of the aforementioned test method is limited to hydrocarbon solvents having a boiling point over 40° C. The method has been modified for application to more volatile substances such as to 30° C.)

The carrier may be selected from a wide variety of materials that are known in the art, but the carrier preferably has a Kauri-Butanol number less than 30. The carrier is typically chemically stable under a variety of conditions and electrically insulating. Electrically insulating refers to a material having a low dielectric constant and a high electrical resistivity. Preferably, the carrier has a dielectric constant of less than 5, more preferably less than 3. Electrical resistivities of carrier are typically greater than $10^9$ Ohm-cm, more preferably greater than $10^{10}$ Ohm-cm. The carrier preferably is also relatively nonviscous in its liquid state at the operating temperature to allow movement of the charged particles during development. In addition, the carrier should be chemically inert with respect to the materials or equipment used in the liquid electrophotographic process, particularly the photoreceptor and its release surface.

A number of classes of organic materials meet some or many of the requirements outlined above. Non-limiting examples of suitable carrier include aliphatic hydrocarbons or paraffins (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons, and the like), silicone oils and waxes, vegetable oils and waxes, animal oils and waxes, petroleum waxes, mineral waxes, synthetic wax, such as Fischer-Tropsch wax, polyethylene wax, branched paraffinic waxes and oils, 12-hydroxystearic acid amide, stearic acid amide, phthalic anhydride imide, and blends of these materials. Preferred carriers include branched paraffinic waxes and oils, and blends of these materials.

The roles of the crystalline polymeric binder resin are to be the vehicle for the pigments or dyes, to provide colloidal stability, and to aid fixing of the final image. The crystalline polymeric binder resin should contain charging sites or be able to incorporate materials that have charging sites. Furthermore, the crystalline polymeric binder resin should have a melting point above 22° C., more preferably above 30° C., and most preferably above 40° C. Non-limiting examples of suitable crystalline polymeric binder resin are polymers or copolymers derived from side-chain crystallizable and main-chain crystallizable polymerizable monomers, oligomers or polymers with melting transitions above 22° C. Suitable crystalline polymeric binder resins include homopolymers or copolymers of alkyl acrylates where the alkyl chain contains more than 13 carbon atoms (e.g., tetradecyl acrylate, pentadecyl acrylate, hexadecyl acrylate, heptadecyl acrylate, octadecyl acrylate, behenyl acrylate, etc); alkyl methacrylates wherein the alkyl chain contains more than 17 carbon atoms; ethylene; propylene; and acrylamide. Other suitable crystalline polymeric binder resins with melting points above 22° C. are derived from aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; amino functional silicone waxes; polymerizable natural waxes, polymerizable synthetic waxes, and other similar type materials known to those skilled in the art.

Suitable crystalline polymeric binder resins can be also an organosol composed of a high molecular weight (co) polymeric graft stabilizer (shell) covalently bonded to an insoluble, thermoplastic (co)polymeric core. The graft stabilizer includes a crystallizable polymeric moiety that is capable of independently and reversibly crystallizing at or above 22° C. The graft stabilizer includes a polymerizable organic compound or mixture of polymerizable organic compounds of which at least one is a polymerizable crystallizable compound (PCC). Suitable PCC's include side-chain crystallizable and main-chain crystallizable polymerizable monomers, oligomers or polymers with melting transitions above 22° C. Suitable PCC's include alkylacrylates where the alkyl chain contains more than 13 carbon atoms (e.g., tetradecylacrylate, pentadecylacrylate, hexadecylacrylate, heptadecylacrylate, octadecylacrylate, etc); alkylmethacrylates wherein the alkyl chain contains more than 17 carbon atoms, ethylene; propylene; and acrylamide. Other suitable PCCs with melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; amino functional silicone waxes; polymerizable natural waxes, polymerizable synthetic waxes, and other similar type materials known to those skilled in the art.

The graft stabilizer should have a melting point above 22° C., more preferably above 30° C., and most preferably above 40° C. Furthermore, the graft stabilizer should have a Hildebrand Solubility Parameter closely matching that of the carrier to ensure that the stabilizer will be sufficiently solubility in the carrier when the carrier is in its liquid state. Virtually any polymerizable compound that exhibits a Hildebrand Solubility Parameter difference less than 3.0 $MPa^{1/2}$ relative to the carrier may be used in forming a crystalline polymeric graft stabilizer provided that the resulted graft stabilizer has a melting point above 22° C. In addition, polymerizable compounds that exhibit a Hildebrand Solubility Parameter difference greater than 3.0 $MPa^{1/2}$ relative to the carrier may be used in forming a copolymeric stabilizer, provided that the effective Hildebrand Solubility Parameter difference between the stabilizer and the carrier is less than 3.0 $MPa^{1/2}$. The absolute difference in Hildebrand Solubility Parameter between the graft stabilizer and the carrier is preferably less than 2.6 $MPa^{1/2}$. The Hildebrand solubility parameter computes the solubility parameter from molecular weight, boiling point and density data, which are commonly available for many materials and which yields values which are usually within the range of other methods of calculation:

$$SP=(\Delta E_{v/V})^{1/2},$$

where V=molecular weight/density and $\Delta E_{v/V}$=energy of vaporization.

Alternatively written, $SP=(\Delta H_{v/V-RT/V})^{1/2}$ where $\Delta H_v$= heat of vaporization, R=gas constant, and T is the absolute temperature, $^{O}K$. For materials, such as high molecular weight polymers, which have vapor pressures too low to detect, and thus for which $\Delta H_v$ is not available, several methods have been developed which use the summation of atomic and group contributions to $\Delta Hv=\Sigma_i \Delta h_i$, where $\Delta h_i$ is the contribution of the $i^{th}$ atom or group to the molar heat of vaporization. One convenient method has been proposed by R. F. Fedors, Polymer Engineering and Science, Vol. 14, p. 147 (1974).

Table 1 lists the Kauri-Butanol Number and Hildebrand solubility parameter for some common carrier liquids used in electrophotographic developers and Table 2 Lists the Hildebrand solubility parameter and glass transition Temperature of common monomers.

TABLE 1

| Solvent Values at 25° C. | | |
|---|---|---|
| Solvent Name | Kauri-Butanol Number by ASTM Method D1133-54T (mL) | Hildebrand Solubility Parameter ($MPa^{1/2}$) |
| Norpar ™ 15 | 18 | 13.99 |
| Norpar ™ 13 | 22 | 14.24 |
| Norpar ™ 12 | 23 | 14.30 |
| Isopar ™ G | 25 | 14.42 |
| Exxsol ™ D80 | 28 | 14.60 |

Source: Calculated from equation No. 31 of *Polymer Handbooks* 3rd Ed., J. Brandrup E. H. Immergut, Eds. John Wiley, NY, p. VII/522 (1989).

TABLE 2

| Monomer Values at 25° C. | | |
|---|---|---|
| Monomer Name | Hildebrand Solubility Parameter ($MPa^{1/2}$)# | Glass Transition Temperature (° C.)* |
| Behenyl Acrylate | 16.74 | / |
| n-Octadecyl Methacrylate | 16.77 | −100 |
| n-Octadecyl Acrylate | 16.82 | −55 |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.90 | 66 |
| Ethyl Acrylate | 18.04 | −24 |
| Methyl Methacrylate | 18.17 | 105 |
| Vinyl Acetate | 19.40 | 30 |
| Methyl Acrylate | 20.2 | 5 |

#Calculated using Small's Group Contribution Method, Small, P.A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209–277 (1989).

It will be understood by those skilled in the art that blocking resistance will be observed at temperatures above 22° C., but below the crystallization temperature of the PCC. Improved blocking resistance is observed when the PCC is a major component of the graft stabilizer, preferably greater than 45% by weight of the graft stabilizer is the PCC, more preferably greater than or equal to 75%, most preferably greater than or equal to 90%. Suitable polymerizable organic compounds for use in the graft stabilizer composition in combination with at least one PCC include monomers such as, 2-ethylhexyl acrylate, lauryl acrylate, 2-ethylhexyl (methacrylate), lauryl methacrylate, hydroxy (ethylmethacrylate), and other acrylates and methacrylates. Other monomers, macromers or polymers may be used either alone or in conjunction with the aforementioned materials, including melamine and melamine formaldehyde resins, phenol formaldehyde resins, epoxy resins, polyester resins, styrene and styrene/acrylic copolymers, acrylic and methacrylic esters, cellulose acetate and cellulose acetate-butyrate copolymers, and poly(vinyl butyral) copolymers. Preferred weight-average molecular weights of the graft stabilizer are not less than 5,000 Daltons (Da), more preferably not less than 50,000 Da, most preferably not less than 150,000 Da.

The polydispersity of the graft stabilizer also has an effect on imaging and transfer performance of phase change developers. Generally, it is desirable to maintain the polydispersity (the ratio of the weight-average molecular weight to the number average molecular weight) of the graft stabilizer below 15, more preferably below 5, most preferably below 2.5.

The graft stabilizer may be chemically bonded to the resin core (e.g., grafted to the core) or may be adsorbed onto the core such that it remains as a physically bound integral part of the resin core. Any number of reactions known to those skilled in the art may be used to effect grafting of the soluble polymeric stabilizer to the organosol core during free radical polymerization. Common grafting methods include random grafting of polyfunctional free radicals; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation reactions or polymerization.

One grafting method is that the grafting site is formed by incorporating hydroxyl groups into the graft stabilizer during a first free radical polymerization and catalytically reacting all or a portion of these hydroxyl groups with an ethylenically unsaturated aliphatic isocyanate (e.g., meta-isopropenyldimethylbenzyl isocyanate [TMI] or 2-cyanatoethylmethacrylate [IEM] to form a polyurethane linkage during a subsequent non-free radical reaction step. The graft stabilizer is then covalently bonded to the nascent insoluble acrylic (co)polymer core via reaction of the unsaturated vinyl group of the grafting site with ethylenically-unsaturated core monomers (e.g., vinyl esters, particularly acrylic and methacrylic esters with carbon numbers less than 7 or vinyl acetate; vinyl aromatics, such as styrene; acrylonitrile; n-vinyl pyrrolidone; vinyl chloride and vinylidene chloride) during a subsequent free radical polymerization step.

Other methods of effecting grafting of the preformed polymeric stabilizer to the incipient insoluble core particle are known to those skilled in the art. For example, alternative grafting protocols are described in sections 3.7–3.8 of Barrett *Dispersion Polymerization in Organic Media*, K. E. J. Barrett, ed., (John Wiley: New York, 1975), pp. 79–106. A particularly useful method for grafting the polymeric stabilizer to core utilizes an anchoring group. The function of the anchoring groups is to provide a covalent link between the core part of the particle and the soluble component of the steric stabilizer. Suitable monomers containing anchoring groups include: adducts of alkenylazlactone comonomers with an unsaturated nucleophile containing hydroxy, amino, or mercaptan groups, such as 2-hydroxyethylnethacrylate, 3-hydroxypropylmethacrylate, 2-hydroxyethylacrylate, pentaerythritol triacrylate, 4-hydroxybutyvinylether, 9-octadecen-1-ol, cinnamyl alcohol, allyl mercaptan, methallylamine; and azlactones, such as 2-alkenyl-4, 4dialkylazlactone of the structure

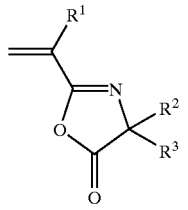

where $R^1$=H, or alkyl groups having 1 to 5 carbons, preferably one carbon, $R^2$ and $R^3$ are independently lower alkyl groups having 1 to 8 carbons, preferably 1 to 4 carbons.

Most preferably, however, the grafting mechanism is accomplished by grafting an ethylenically-unsaturated isocyanate (e.g., dimethyl-m-isopropenyl benzylisocyanate, available from American Cyanamid) to hydroxyl groups previously incorporated into the graft stabilizer precursor (e.g., by use of hydroxy ethyl methacrylate).

The core polymer may be made in situ by copolymerization with the stabilizer monomer. The composition of the insoluble resin core is preferentially manipulated such that the resin core exhibits a low glass transition temperature (Tg) that allows one to formulate a developer composition containing the resin as a major component to undergo rapid film formation (rapid self-fixing) in printing or imaging processes carried out at temperatures greater than the core Tg, preferably at or above 23° C. Rapid self-fixing assists in avoiding printing defects (such as smearing or trailing-edge tailing) and incomplete transfer in high speed printing. The core Tg of should be below 23° C., more preferably less than 10° C., most preferably less than −10° C.

Non-limiting examples of polymerizable organic compounds suitable for use in the organosol core include (meth) acrylates such as methyl acrylate, ethyl acrylate, butyl acrylate, methyl(methacrylate), ethyl(methacrylate), butyl (methacrylate); (meth)acrylates having aliphatic amino groups such as N,N-dimethylaminoethyl(meth)acrylate, N,N-diethylaminoethyl(meth)acrylate, N,N-dibutylaminoethyl(meth)acrylate, N,N-hydroxyethylaminoethyl(meth)acrylate, N-benzyl,N-ethylarinoethyl(meth)acrylate, N,N-dibenzylaminoethyl (meth)acrylate, N-octyl,N,N-dihexyiaminoethyl(meth) acrylate and the like; nitrogen-containing heterocyclic vinyl monomers such as N-vinylimidazole, N-vinylindazole, N-vinyltetrazole, 2-vinylpyridine, 4-vinylpyridine, 2-methyl-5-vinylpyridine, 2-vinylquinoline, 4-vinylquinoline, 2-vinylpyrazine, 2-vinyloxazole, 2-vinylbenzooxazole and the like; N-vinyl substituted ring-like amide monomers such as N-vinylpyrrolidone, N-vinylpiperidone, N-vinyloxazolidone and the like; (meth) acrylamides such as N-methylacrylamide, N-octylacrylamide, N-phenylmethacrylamide, N-cyclohexylacrylamide, N-phenylethylacrylamide, N-p-methoxy-phenylacrylamide, acrylamide, N,N-dimethylacrylamide, N,N-dibutylacrylamide, N-methyl,N-phenylacrylamide, piperidine acrylate, morpholine acrylate and the like; aromatic substituted ethylene monomers containing amino groups such as dimethiaminostyrene, diethylaminostyrene, diethylaminomethylstyrene, dioctylaminostyrene and the like; and nitrogen-containing vinylether monomers such as vinyl-N-ethyl-N-phenylaminoethylether, vinyl-N-butyl-N-phenylaminoethylether, triethanolamine divinylether, vinyldiphenylaminoethylether, vinypyrrolizylaminoether, vinyl-beta-morpholinoethylether, N-vinylhydroxyethylbenzamide, m-arninophenylvinylether and the like, and other acrylates and methacrylates, most preferred being methylnethacrylate and ethylacrylate.

Other polymers which may be used either alone or in conjunction with the aforementioned materials, include melamine and melamine formaldehyde resins, phenol formaldehyde resins, epoxy resins, polyester resins, styrene and styrene/acrylic copolymers, vinyl acetate and vinyl acetate/acrylic copolymers, acrylic and methacrylic esters, cellulose acetate and cellulose acetate-butyrate copolymers, and poly (vinyl butyral) copolymers.

The optimal weight ratio of the resin core to the stabilizer shell is on the order of 1/1 to 15/1, preferably between 2/1 and 10/1, and most preferably between 4/1 and 8/1. Undesirable effects may accompany core/shell ratios selected outside of these ranges. For example, at high core/shell ratios (above 15), there may be insufficient graft stabilizer present to sterically-stabilize the organosol with respect to aggregation. At low core/shell ratios (below 1), the polymerization may have insufficient driving force to form a distinct particulate phase resulting in a copolymer solution, not a self-stable organosol dispersion. The particle size of the organosol also influences the imaging, drying and transfer characteristics of the developers. Preferably, the primary particle size (determined with dynamic light scattering) of the organosol is between about 0.05 and 5.0 microns, more preferably between 0.15 and 1 micron, most preferably between 0.20 and 0.50 microns.

A phase change developer utilizing the aforementioned organosol comprises colorant particles embedded in the thermoplastic organosol resin. Useful colorants are well known in the art and include materials such as dyes, stains, and pigments. Preferred colorants are pigments that may be incorporated into the polymer binder resin, are nominally insoluble in and nonreactive with the carrier, and are useful and effective in making visible the latent electrostatic image. Non-limiting examples of typically suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105, 138 and 111), azo red (C.I. Pigment Red 3, 17, 22, 23, 38, 48:1, 48:2, 52:1, 81, 81:4 and 179), quinacridone magenta (C.I. Pigment Red 122, 202 and 209) and black pigments such as finely divided carbon (Cabot Monarch 120, Cabot Regal 300R, Cabot Regal 350R, Vulcan X72) and the like.

The optimal weight ratio of binder resin to colorant in the developer particles is on the order of 1/1 to 20/1, preferably between 3/1 and 10/1 and most preferably between 5/1 and 8/1. The total dispersed material in the carrier typically represents 0.5 to 70 weight percent, preferably between 5 and 50 weight percent, most preferably between 10 and 40 weight percent of the total developer composition.

An electrophotographic phase change developer may be formulated by incorporating a charge control agent into the phase change developer. The charge control agent, also known as a charge director, provides improved uniform charge polarity of the developer particles. The charge director may be incorporated into the developer particles using a variety of methods, such as chemically reacting the charge director with the developer particle, chemically or physically adsorbing the charge director onto the developer particle (binder resin or pigment), or chelating the charge director to a functional group incorporated into the developer particle. A preferred method is attachment via a functional group built into the graft stabilizer. The charge director acts to impart an electrical charge of selected polarity onto the developer particles. Any number of charge directors described in the art may be used. For example, the charge director may be introduced in the form of metal salts consisting of polyvalent metal ions and organic anions as the counterion. Non-limiting examples of suitable metal ions include Ba(II), Ca(II), Mn(II), Zn(II), Zr(IV), Cu(II), Al(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Non-limiting examples of suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps) described in U.S. Pat. No. 3,411,936, incorporated herein by reference, which include alkaline earth- and heavy-metallic salts of fatty acids containing at least 6–7 carbons and cyclic aliphatic acids including naphthenic acid; more preferred are polyvalent metal soaps of zirconium and aluminum; most preferred is the zirconium soap of octanoic acid (Zirconium HEX-CEM from Mooney Chemicals, Cleveland, Ohio).

The preferred charge direction levels for a given phase change developer formulation will depend upon a number of factors, including the composition of the graft stabilizer and organosol, the molecular weight of the organosol, the particle size of the organosol, the core/shell ratio of the graft stabilizer, the pigment used in making the developer, and the ratio of binder resin to pigment. In addition, preferred charge direction levels will also depend upon the nature of the electrophotographic imaging process, particularly the design of the developing hardware and photoconductive element. Those skilled in the art, however, know how to adjust the level of charge direction based on the listed parameters to achieve the desired results for their particular application.

The useful conductivity range of a phase change developer is from about 10 to 1200 picomho-cm$^{-1}$. High conductivities generally indicate inefficient association of the charges on the developer particles and is seen in the low relationship between current density and developer deposited during development. Low conductivities indicate little or no charging of the developer particles and lead to very low development rates. The use of charge director compounds to ensure sufficient charge associated with each particle is a common practice. There has, in recent times, been a realization that even with the use of charge directors there can be much unwanted charge situated on charged species in solution in the carrier. Such unwanted charge produces inefficiency, instability and inconsistency in the development.

Any number of methods may be used for effecting particle size reduction of the pigment in preparation of the phase change developers. Some suitable methods include high shear homogenization, ball-milling, attritor milling, high energy bead(sand) milling, and other means known in the art. The operating temperature during particle size reduction is above the melting point of the crystalline polymeric binder resin. The resulted phase change developer is either cooled to room temperature to form a solid which optionally may be turned into a powder by pulverizing; sprayed to form droplets which then are cooled to form a powder; transferred to a mold and then cooled to form a shaped solid; or coated on a substrate and then cooled to form a coated web with a layer of the phase change developer.

The phase change developer of this invention may be stored and delivered to a liquid electrophotography imaging system in many different ways. Non-limiting examples of such developer storage and delivery system are described below.

Figure 2:
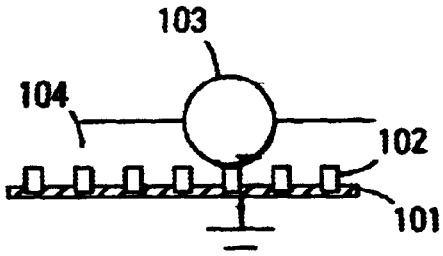
FIG. 2 is a diagrammatic illustration of a developer storage and delivery system wherein a continuous coating of a phase change developer is placed on top of both a conductive substrate and discrete conductive heating elements.

The first two examples of developer storage and delivery system for the phase change developer of this invention are shown in FIG. 1 and FIG. 2. The phase change developer storage and delivery system comprises conductive substrate 101 in the form of a continuous web or an endless belt or loop. The phase change developer storage and delivery system also comprises phase change developer 104 which is placed on top of discrete conductive heating elements 102. Conductive heating elements 102 may be in the form of a coating, a stripe, a bar, or any other useful forms or shapes. Phase change developer 104 may be in the form of discrete stripes, bars, or coatings placing on top of conductive heating elements 102, as shown in FIG. 1, or in the form of a continuous coating placing on top of both conductive heating elements 102 and conductive substrate 101, as shown in FIG. 2. Phase change developer 104 can be applied on conductive heating elements 102 by gravure coating, roll coating, curtain coating, extrusion, lamination, spraying, or other coating techniques. The coating of phase change developer 102 may be assisted with ultrasound, electrical field or magnetic field.

The toner images plated on the surface of organophotoreceptor 10 is further dried by drying mechanism 34. Drying mechanism 34 may be passive, may utilize active air blowers blowing hot air 90, or may be other active devices such as rollers or IP lamp. In a preferred embodiment, drying mechanism is passive such that most of the carrier fluid is absorbed by the receiving medium.

The components described above are all conventional in the art and any suitable combination of materials for conductive substrate 101, conductive heating elements 102 and phase change developer 104 may be employed in these phase change developer storage and delivery systems.

Conductive heating elements 102 are either perpendicular or skewed at an angle to the edges of substrate 101. External electrical contact 103 is used to pass a current through each of conductive heating elements 102. Therefore, good conductivity between external electrical contact 103 and discrete conductive heating elements 102 is needed and may be provided by keeping a small portion of the top surface of each of conductive heating elements 102 free of phase change developer 104. When a current is passed from electrical contact 103 through each of conductive heating elements 102 one by one, phase change developer 104 on each of conductive heating elements 102 is melted and turned into liquid state one by one. These phase change developer storage and delivery systems may be run continuously or be indexed.

The term "phase change developer" has an accepted meaning within the imaging art, however, some additional comments are useful in view of phenomic differences amongst mechanisms in this field. As the term indicates, the developer system is present as one physical phase under storage conditions (e.g., usually a solid) and transitions into another phase during development (usually a liquid phase), usually under the influence of heat or other directed energy sources. There are basically two preferred mechanisms in which these phase changes appear: a) complete conversion of the phase change developer layer from a solid to a liquid and b) release of a liquid from a phase change developer layer with a solid carrier in the phase change developer layer remaining as a solid during and after development. The first system operates by the entire layer softening to a point where the entire layer flows, carrying the active developer component to the charge distributed areas and depositing the developer composition on the appropriate areas where the charges attract the developer. In this case, the developer may be originally or finally in a solid phase or liquid phase within the phase change developer layer, but with the softened (flowable or liquefied) layer carrying the developer or allowing the developer to move over the surface of the layer having image-effecting charge distribution over its surface. The second system, where a liquid developer forms on the surface of the phase change developer carrying layer, usually maintains a solid carrying layer with a liquid developer provided on the surface of the carrier layer. This system may function, for example, by the developer having a lower softening point or even being present as a liquid (e.g., liquid/solid dispersion, liquid/solid emulsion) in the solid carrier layer. Upon activation or stimulation (e.g., by energy, such as heat), the developer composition will exude or otherwise emit from the surface of the solid carrier. This can occur by a number of different phenomena, and the practice of the invention is not limited to any specifically described phenomenon. For example, a phase change developer layer may be constructed by blending a developer composition that is solid at 22° C., which may be dispersed in a solid binder that is solid at 70° C., and the phase change developer composition coated on the imaging surface. Upon heating of the phase change developer layer to a temperature between 25° C. and 65° C., for example, especially where the developer composition is present at from 1–60% by weight of the phase change developer layer, the developer will soften or liquefy, and the developer composition will flow to the surface of the developer layer. The developer may be present as droplets and spread by physical action or may flow in sufficient volume to wet the surface of the developer layer and form a continuous layer of liquid. Thus, in the practice of the present invention, the phase change developer layer may be heated above room temperature and below or above the melt, softening or flow temperature of the carrier solid in the phase change developer layer. Melting points of the thermoplastic core or the activation temperature of the phase change developer is preferred to be between 30 and 90° C., between 35° C. and 85° C., between 40 and 80° C., and between 40 and 75° C.

In certain aspects of process steps of the invention, the melting point of the phase transfer developer has been described as in the range of 22 to 40° C. If the melting point of the phase transfer developer is less than 22° C., the phase transfer developer will not be solid at room temperature. If the melting point of the phase transfer developer is greater than 40° C., image splitting may occur. In other aspects of process steps of the invention, the viscosity of the phase transfer developer is described as in the range of 0.001 to 0.01 pascal second. If the viscosity of the phase transfer developer is less than 0.001 pascal second, the liquid phase transfer developer will become too thin to be transferred on the developer, and the viscosity of the phase transfer developer is greater than 0.01 pascal second, the mobility of the liquid phase transfer developer will be too low for effective development of toned images.

The concept of an 'activation point' or 'activation temperature' is particularly easily understood in the concept of the present invention. At room temperature, below the activation temperature, the phase change developer layer will not allow the developer to readily distribute over the differentially charged layer to form a pattern or latent image or image in response to the distribution of charges. When the activation temperature has been exceeded on the phase change developer layer, the developer becomes able to be distributed over the differentially charged layer to form a pattern or latent image or image in response to the distribution of charges. The activation point or activation temperature is therefore the temperature at which the phase change developer layer passes from a state in which the developer is electrophotographically inactive to a state where the developer is electrophotographically active, as the temperature increases.

Figure 3:
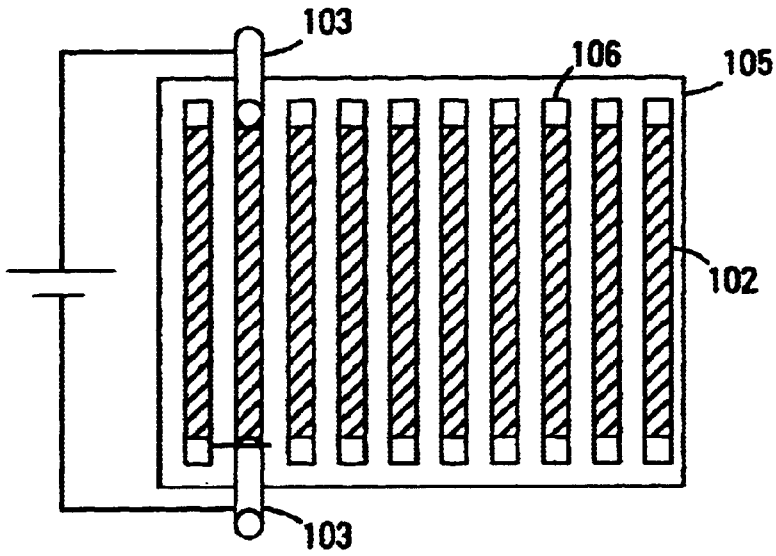
FIG. 3 is a diagrammatic illustration of a developer storage and delivery system wherein stripes of conductive heating element are placed on an insulated substrate, optional electrical leads in contact with each end of the stripes, and no phase change developer is shown.

The third example of developer storage and delivery system for the phase change developer of this invention is shown in FIG. 3. The phase change developer is not shown in FIG. 3. However, it should be placed on top of conductive heating elements 102. Conductive heating elements 102 are placed on an electrically insulating substrate 105. Optionally, conductive contacts 106 are used to pass current through each of conductive heating elements 102 one by one by contacting electrical contacts 103. The conductive contacts 106 may be completely exposed areas or comprises areas over resistive heating elements that are coated by an essentially solid layer of phase change developer in which contact regions (comprising a minor amount of the surface area of the phase change developer layer or a minor or small portion of that layer over the resistive heating elements (as taught in copending application Docket Number 456.007US1, filed this same date, which is referenced and incorporated by reference herein). The phase change developer storage and delivery system may be run continuously or be indexed. When a current is applied to conductive heating elements 102, the phase change developer is melted and turned into liquid state that may be used subsequently in a liquid electrophotography process. The components described in FIG. 3 are all conventional in the art and any suitable combination of materials for insulating substrate 105, conductive heating elements 102, conductive contacts 106, and the phase change developer may be employed in the phase change developer storage and delivery system of the invention.

Figure 4:
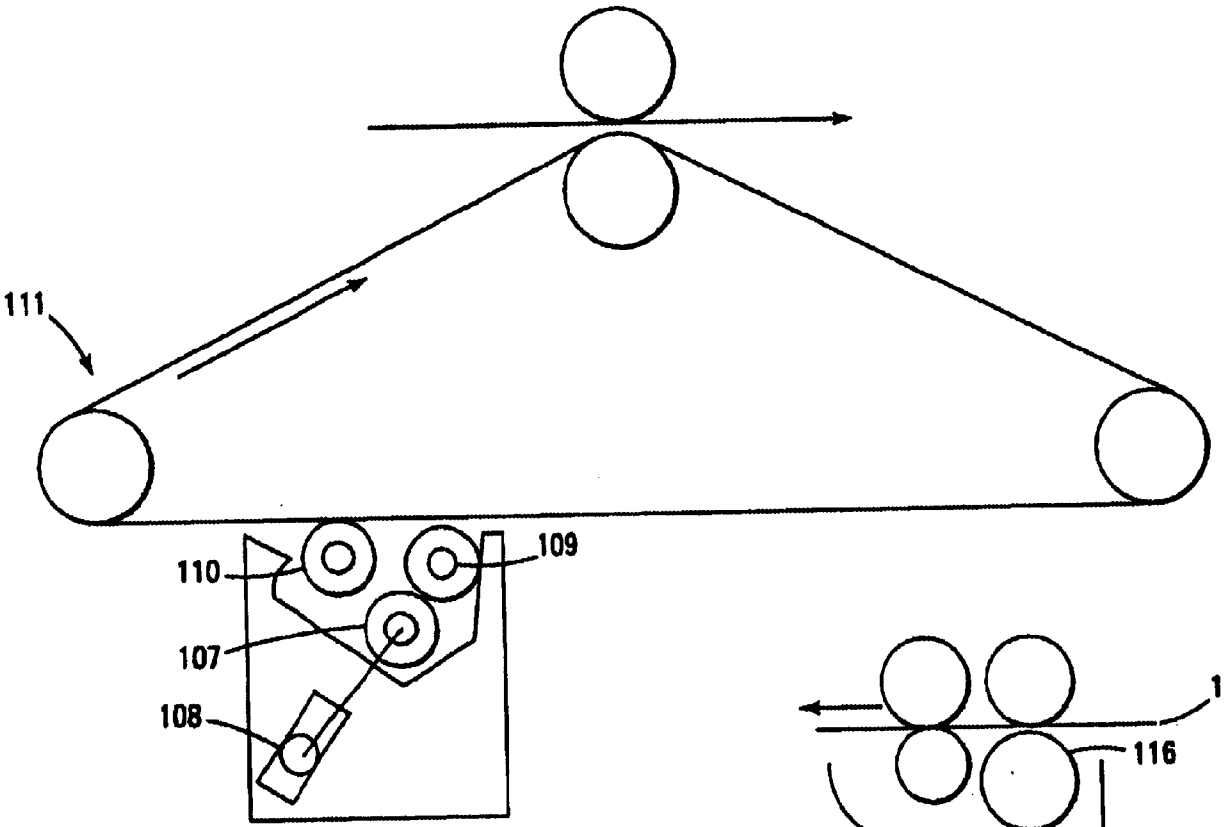
FIG. 4 is a diagrammatic illustration of a developer storage and delivery system wherein a phase change developer is shaped into a roll and liquefied into a liquid developer by a developer roll.

The fourth example of developer storage and delivery system for the phase change developer of this invention is shown in FIG. 4. The solid phase change developer of this invention is molded onto a core to form cylindrical developer stick 107. The developer stick 107 is mounted on developer holder 108 so that developer stick 107 comes in contact with developer roll 109. Developer roll 109 is rotated at a suitable speed during the development stage of the electrophotographic process to generate a shear force causing the outermost surface of developer stick 107 to liquefy. Alternatively, developer roll 109 is heated to melt only the outermost surface of developer stick 107. When the phase change developer becomes liquid, a charge is applied to developer roll 107 causing the toner particle in the liquid developer to migrate to the surface of photoreceptor 111. Developer stick 107 rotates at the same speed as the developer roll 109 in order to maintain the concentricity of developer stick 107. Developer stick 107 is mounted on developer holder 108 that allows developer stick 107 to index closer to developer roll 109 as the outer surface of developer stick 107 is used in the printing process through the use of springs, groves or other means.

Figure 5:
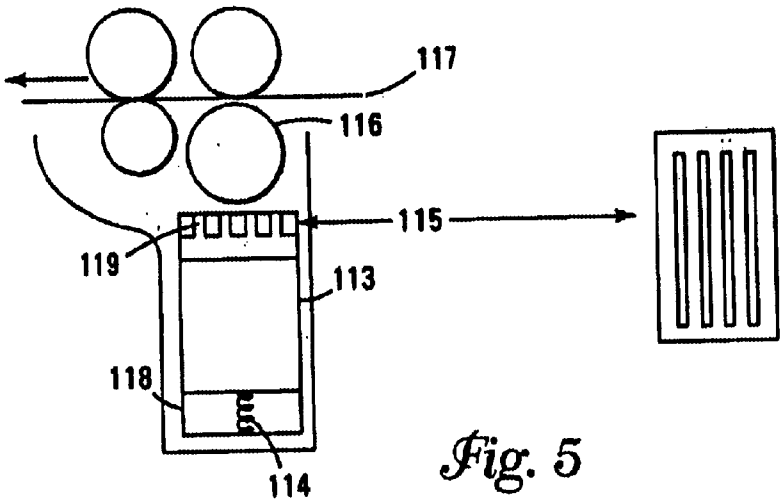
FIG. 5 is a diagrammatic illustration of a developer storage and delivery system wherein a block of phase change developer is urging toward a heating element and the surface of the phase change developer block is melted and transferred to a developer roll.

The fifth example of developer storage and delivery system for the phase change developer of this invention is shown in FIG. 5. This concept of a developer storage and delivery system comprises solid phase change developer 118 in develop unit 113. Solid phase change developer 118 is urged toward heating element 115 with openings or perforations by indexing unit 114. Solid phase change developer 118 is melted by heating element 115 to form liquid developer 119 near and in the openings or perforations of heating element 115. Liquid developer 119 is urged toward developer roll 116 through the openings or perforations. Develop unit 113 may be insulated. Heating element 115 may be made of any material that is resistant to heat and carrier liquids such as hydrocarbons. Non-limiting examples of materials for heating element 115 are metals and ceramics. Solid phase change developer 118 below heating element 115 would remain in a solid form until it comes in contact with heating element 115. Heating element 115 would heat a thin layer of developer at the top to an appropriate temperature that would allow the toner particles to have the correct mobility and conductivity to be useful in a printing mode. As liquid developer 119 is used in the printing process, the solid ink would be indexed up by indexing unit 114 to allow the printing apparatus to have a constant source of developer. This indexing could be done by using spring loading and tension, a print or dot counting device that manual indexes solid phase change developer 118 up according to use; or a device that uses weight as an indication of the need to index.

In electrophotography, the electrostatic image is typically formed on a sheet, drum or belt coated with a photoconductive element by (1) uniformly charging the photoconductive element with an applied voltage, (2) exposing and discharging portions of the photoconductive element with a radiation source to form a latent image, (3) applying a developer to the latent image to form a toned image, and (4) transferring the toned image through one or more steps to a final receptor sheet. In some applications, it may be desirable to fix the toned image using a heated pressure roller or other fixing methods known in the art.

A preferred method and structure for use of phase change developers is described in copending U.S. patent application Ser. No. 10/___,___, bearing attorney's docket number 456.007US1 filed the same date as this Application and titled "DEVELOPER STORAGE AND DELIVERY SYSTEM FOR LIQUID ELECTROPHOTOGRAPHY," which application is incorporated herein by reference for its teachings of phase change developer systems, compositions and structures.

In this invention, the electrostatic charge of the developer particles may be either positive or negative. If electrophotography is carried out by dissipating charge on a positively (or negatively) charged photoconductive element, a positively (or negatively) charged developer is then applied to the regions in which the positive (or negative) charge was dissipated to develop a toned image. This image development may be accomplished by using a uniform electric field produced by a development electrode spaced near the photoconductive element surface. The phase change developer is heated to a temperature above its melting point. A bias voltage is applied to the electrode intermediate to the initially charged surface voltage and the exposed surface voltage level. The voltage is adjusted to obtain the required maximum density level and tone reproduction scale for halftone dots without any background deposited The molten phase change developer is then caused to flow between the electrode and the photoconductive element. The charged developer particles are mobile in the field and are attracted to the discharged areas on the photoconductive element while being repelled from the non-discharged, non-image areas. Excess molten developer remaining on the photoconductive element is removed by techniques well known in the art. Thereafter, the photoconductive element surface may be force dried or allowed to dry at ambient conditions.

The substrate for receiving the image from the photoconductive element can be any commonly used receptor material, such as paper, coated paper, polymeric films and primed or coated polymeric films. Specially coated or treated metal or metallized surfaces may also be used as receptors. Polymeric films include plasticized and compounded polyvinyl chloride PVC), acrylics, polyurethanes, polyethylene/acrylic acid copolymer, and polyvinyl butyrals. Commercially available composite materials such as those having the trade designations Scotchcal™, Scotchlite™, and Panaflex™ film materials are also suitable for preparing substrates.

The transfer of the formed image from the charged surface to the final receptor or transfer medium may be enhanced by the incorporation of a release-promoting material within the dispersed particles used to form the image. The incorporation of a silicone-containing material or a fluorine-containing material in the outer (shell) layer of the particle facilitates the efficient transfer of the image.

In multicolor imaging, the developers may be applied to the surface of the dielectric element or photoconductive element in any order, but for colorimetric reasons, bearing in mind the inversion that occurs on transfer, it is sometimes preferred to apply the images in a specified order depending upon the transparency and intensity of the colors. A preferred order for a direct imaging or a double transfer process is yellow, magenta, cyan and black; for a single transfer process, the preferred order is black, cyan, magenta and yellow. Yellow is generally imaged first on the photoreceptor to avoid contamination from other developers and to be the topmost color layer when transferred. Black is generally imaged last on the photoreceptor due to the black developer acting as a filter of the radiation source and to be the bottom-most layer after transfer.

Overcoating of the transferred image may optionally be carried out to protect the image from physical damage and/or actinic damage. Compositions for overcoatings are well known in the art and typically comprise a clear film-forming polymer dissolved or suspended in a volatile solvent. An ultraviolet light absorbing agent may optionally be added to the coating composition. Lamination of protective layers to the image-beating surface is also well known in the art and may be used with this invention.

These and other aspects of the present invention are demonstrated in the illustrative examples that follow. These examples are to be viewed as illustrative of specific materials filling within the broader disclosure presented above and are not to be viewed as limiting the broader disclosure.

EXAMPLES

Glossary of Chemical Abbreviations & Chemical Sources

The following raw materials were used to prepare the polymers in the examples which follow:

The catalysts used in the examples are Azobisisobutyronitrile (designated as AIBN, commercially obtained as VAZO™-64 from DuPont Chemicals, Wilmington, Del.); Dibutyl Tin Dilaurate (designated as DBTDL, commercially obtained from Aldrich Chemical Co., Milwaukee, Wis.); and 2,2'-Azobisisobutyronitrile (designated as AZDN, commercially obtained from Elf Atochem, Philadelphia, Pa.). The monomers are all available from Scientific Polymer Products, Inc., Ontario, N.Y. unless designated otherwise.

The monomers used in the examples are designated by the following abbreviations: Dimethyl-m-isopropenyl benzylisocyanate (TMI, commercially obtained from CYTEC Industries, West Paterson, N.J.); Ethyl Acrylate (EA); 2-Hydroxyethyl Methacrylate (HEMA); lauryl methacryate (LMA); methyl methacrylate (MMA); octadecyl methacrylate (ODA); and behenyl acrylate (BHA).

TEST METHODS

The following test methods were used to characterize the polymers and developers in the examples that follow:

A. Graft Stabilizer Molecular Weight

Various properties of the graft stabilizer have been determined to be important to the performance of the stabilizer, including molecular weight and molecular weight polydispersity. Graft stabilizer molecular weight is normally expressed in terms of the weight average molecular weight ($M_w$), while molecular weight polydispersity is given by the ratio of the weight average molecular weight to the number average molecular weight ($M_w/M_n$). Molecular weight parameters were determined for graft stabilizers with gel permeation chromatography (GPC) using tetrahydrofuran as the carrier solvent. Absolute $M_w$ was determined using a Dawn DSP-F light scattering detector (commercially obtained from Wyatt Technology Corp, Santa Barbara, Calif.), while polydispersity was evaluated by ratioing the measured $M_w$ to a value of $M_n$ determined with an Optilab 903 differential refractometer detector (commercially obtained from Wyatt Technology Corp, Santa Barbara, Calif.).

B. Graft Stabilizer And Phase Change Developer Melting Point

The melting points of g stabilizers were collected using a TA Instruments Model 2929 Differential Scanning Calorimeter (New Castle, Del.) equipped with a DSC refrigerated cooling system (−70° C. minimum temperature limit), and dry helium and nitrogen exchange gases. The calorimeter ran on a Thermal Analyst 2100 workstation with version 8.10B software. An empty aluminum pall was used as the reference. The scanning rate was 10.0° C./min. The temperature range was from −70° C. to 200° C.

C. Percent Solids of Graft Stabilizer, Organosol and Developer

Percent solids of the graft stabilizer solutions, and the organosol and ink dispersions, were determined gravimetrically using a halogen lamp drying oven attachment to a precision analytic balance (commercially obtained from Mettler Instruments Inc., Hightstown, N.J.). Approximately two grams of sample were used in each determination of percent solids using this sample dry down method.

D. Preparation of Graft Stabilizers

Comparative Example A

To a 5000 ml 3-neck round flask equipped with a condenser, a thermocouple connected to a digital temperature controller, a nitrogen inlet tube connected to a source of dry nitrogen and a magnetic stirrer, was charged with a mixture of 2561 g of Norpar™12,848 g of LMA, 27.3 g of 96% HEMA and 8.75 g of AIBN. While the mixture was magnetically stirred, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/min. The mixture was heated to 70° C. for 16 hours. The conversion was quantitative.

The mixture was heated to 90° C. and held at th temperature for 1 hour to destroy any residual AIBN, then was cooled back to 70° C. The nitrogen inlet tube was then removed, and 13.6 g of 95% DBTDL were added to the mixture, followed by 41.1 g of TMI. TMI was added drop wise over the course of approximately 5 minutes while the mixture was magnetically stirred. The nitrogen inlet tube was reinserted, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was then cooled to room temperature to form a graft stabilizer. The graft stabilizer was a viscous, transparent liquid containing no visible insoluble matter. The percent solid of the graft stabilizer was determined to be 26.4%. The graft stabilizer had a Mw of 197,750 Da and a Mw/Mn of 1.84, based on two independent measurements. The graft stabilizer was a copolymer of LMA and HEMA containing random side chains of TMI suitable for making an organosol. The graft stabilizer is designed herein as LMA/HEMA-TMI (97/3-4.7% w/w).

Example 1

A 0.72 liter (32 ounce) narrow-mouthed glass bottle was charged with 483 g of Norpar™12,160 of ODA (Ciba Specialty Chemicals, USA), 5.1 g of 98% HEMA and 1.57 g of AZDN. The bottle was purged for 1 minute with dry nitrogen at a rate of approximately 1.5 liters/min, then sealed with a screw cap fitted with a Teflon liner. The cap was secured in place using an electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 rpm with a water bath temperature of 70° C. The mixture was allowed to react for approximately 16-18 hours at which time the conversion of monomer to polymer was quantitative. The mixture was heated to 90° C. for 1 hour to destroy any residual AZDN, then was cooled to room temperature.

The bottle was then opened and 2.6 g of 95% DBTDL and 7.8 g of TMI were added to the mixture. The bottle was purged for 1 minute with dry nitrogen at a rate of approximately 1.5 liters/min, then sealed with a screw cap fitted with Teflon liner. The cap was secured with a screw using electrical tape. The sealed bottle was then inserted into a metal cage assembly and installed on the agitator assembly of the Atlas Launder-Ometer. The Launder-Ometer was operated at its fixed agitation speed of 42 rpm with a water bath temperature of 70° C. The mixture was allowed to react for approximately 4–6 hours, at which time the conversion was quantitative. The mixture was then cooled to room temperature to form a graft stabilizer. The graft stabilizer was a white paste.

The percent of solids of the graft stabilizer was 25.78%. The graft stabilizer had a Mw of 184.651 and a Mw/Mn of 2.26. The graft stabilizer was a copolymer of ODA and HEMA containing random side chains of TMI. The graft stabilizer is designed herein as ODA/HEMA-TMI (97/3-4.7 w/w %).

Example 2

A 0.72 liter (32 ounce) narrow-mouthed glass bottle was charged with 483 g of Norpar™2,160 g of BHA (Ciba Specialty Chemicals, USA), 5.1 g of 98% HEMA, and 1.57 g of AZDN. The bottle was purged for 1 minute with dry nitrogen at a rate of approximately 1.5 liters/min, then sealed with a screw cap fitted with a Teflon liner. The cap was secured in place using an electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 rpm with a water bath temperature of 70° C. The mixture was allowed to react for approximately 16–18 hours at which time the conversion of monomer to polymer was quantitative. The mixture was heated to 90° C. for 1 hour to destroy any residual AZDN, then was cooled to room temperature.

The bottle was then opened and 2.6 g of 95% DBTDL and 7.8 g of TMI were added to the mixture. The bottle was purged for 1 minute with dry nitrogen at a rate of approximately 1.5 liters/min, then sealed with a screw cap fitted with Teflon liner. The cap was secured with a screw using an electrical tape. The sealed bottle was then inserted into a metal cage assembly and installed on the agitator assembly of the Atlas Launder-Ometer. The Launder-Ometer was operated at its fixed agitation speed of 42 rpm with a water bath temperature of 70° C. The mixture was allowed to react for approximately 4–6 hours, at which time the conversion was quantitative. The mixture was then cooled to room temperature to form a graft stabilizer. The graft stabilizer was a white solid.

The percent of solids of graft stabilizer was 25.74%. The graft stabilizer had a Mw of 165,900 and a Mw/Mn of 3.89. The product was a copolymer of BHA and HEMA containing random side chains of TMI. The graft stabilizer is designed herein as BHA/HEMA-TMI (97/3-4.7 w/w %).

TABLE 1

Graft Stabilizers

| Example | Graft Stabilizer (% w/w) | Molecular Weight Mw | Mw/Mn | Tm (° C.) |
|---|---|---|---|---|
| Comparative Example A | LMA/HEMA-TMI (97/3–4.7) | 197,750 | 1.84 | −22 (Liquid @RT) |
| Example 1 | ODA/HEMA-TMI (97/3–4.7) | 184,651 | 2.26 | 45 |
| Example 2 | BHA/HEMA-TMI (97/3–4.7) | 165,900 | 3.89 | 60 |

Tm (° C.) means the melt temperature in degrees Centigrade

E. Preparation of Organosols

Comparative Example B

Organosol Comparative Example B was prepared by using graft stabilizer Comparative Example A. To a 5000 ml 3-neck round flask equipped with a condenser, a thermocouple connected to a digital temperature controller, a nitrogen inlet tube connected to a source of dry nitrogen, and a magnetic stirrer, was charged with a mixture of 2950 g of Norpar™12,281 g of EA, 93 g of MMA, 170 g of Comparative Example A at 26.4% solids, and 6.3 g of AIBN. While the mixture was magnetically stirred, the reaction flask was purged with dry nitrogen for 30 minutes at a flow rate of approximately 2 liters/minute. A hollow glass stopper was then inserted into the open end of the condenser and the nitrogen flow rate was reduced to approximately 0.5 liters/min. The mixture was heated to 70° C. for 16 hours. The conversion was quantitative.

Approximately 350 g of n-heptane was added to the cooled mixture, and the resulting mixture was stripped of residual monomer using a rotary evaporator equipped with a dry ice/acetone condenser and operating at a temperature of 90° C. and a vacuum of approximately 15 mm Hg. The stripped mixture was cooled to room temperature, yielding an opaque white organosol formed a weak gel over the course of approximately 2 hours.

This gel organosol is designed LMA/HEMA-TMI//MMA/EA (97/3-4.7//25/75% w/w).

Example 3

A 0.72 liter (32 ounce) narrow-mouthed glass bottle was charged with 527 g of Norpar™12, 15.60 g MMA, 46.80 g of EA, 60 g of the graft stabilizer mixture from Example 1 at 25.78% solids, and 0.94 AIBN. The bottle was purged for 1 minute with dry nitrogen at a rate of approximately 1.5 liters/min, then sealed with a screw cap fitted with a Teflon liner. The cap was secured in place using an electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 rpm with a water bath temperature of 70° C. The mixture was allowed to react for approximately 16–18 hours at which time the conversion of monomer to polymer was quantitative. The mixture then was cooled to room temperature.

Approximately 65 g of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was an opaque solid when cooled to room temperature.

This organosol is designed ODA/HEMA-TMI//MMA/EA (97/3-4.7//25/75% w/w).

Example 4

A 0.72 liter (32 ounce) narrow-mouthed glass bottle was charged with 527 g of Norpar™12, 15.60 g MMA, 46.80 g of EA, 60 g of the graft stabilizer mixture from Example 2 at 25.74% solids, and 0.94 AIBN. The bottle was purged for 1 minute with dry nitrogen at a rate of approximately 1.5 liters/min, then sealed with a screw cap fitted with a Teflon liner. The cap was secured in place using an electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 rpm with a water bath temperature of 70° C. The mixture was allowed to react for approximately 16–18 hours at which time the conversion of monomer to polymer was quantitative. The mixture then was cooled to room temperature.

Approximately 65 g of n-heptane were added to the cooled organosol, and the resulting mire was stripped of residual monomer using a rotary evaporator equipped with a dry ice/acetone condenser and operating at a temperature of 90° C. and a vacuum of approximately 15 mm Hg. The stripped organosol was an opaque solid when cooled to room temperature.

Tishorganosol is designed BHA/HEMA-TMI//MMA/EA (97/3-4.7//25/75% w/w).

Example 5

A 0.72 liter (32 ounce) narrow-mouthed glass bottle was charged with 527 g of Norpar™12, 37.44 g of EA, 12.48 g of MAA, 12.48 g of BHA and the graft stabilizer mixture from Example 2 at 25.74% solids, and 0.94 AIBN. The bottle was purged for 1 minute with dry nitrogen at a rate of approximately 1.5 liters/min, then sealed with a screw cap fitted with a Teflon liner. The cap was secured in place using an electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 rpm with a water bath temperature of 70° C. The mixture was allowed to react for approximately 16–18 hours at which time the conversion of monomer to polymer was quantitative. The mixture then was cooled to room temperature.

Approximately 65 g of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was an opaque solid when cooled to room temperature. This organosol is designed BHA/HEMA-TMI//MMA/EA/BHA (97/3-4.7//20/60/20% w/w).

Example 6

This example illustrates the use of the silicone wax to prepare a solid organosoL A 5000 ml 3-neck round flask equipped with a condenser, a thermocouple connected to a digital temperature controller, a nitrogen inlet tube connected to a source of dry nitrogen and a magnetic stirrer, was charged with a mixture of 1587 g of Norpar™12,84 g of Silicone Wax GP-628 (Genesee Polymers Corporation, Flint, Mich.), 8.4 g of TMI, 224 g of EA, 112 g of MMA, and 6.3 g of AIBN. While the mire was magnetically stirred, the reaction flask was purged with dry nitrogen for 30 minutes at a flow rate of approximately 2 liters/minute. A hollow glass stopper was then inserted into the open end of the condenser and the nitrogen flow rate was reduced to approximately 0.5 liters/min. The mixture was heated to 70° C. for 16 hours. The conversion was quantitative.

Approximately 350 g of n-heptane was added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white solid. This organosol is designed Silicone Wax-TMI/MMA/EA.

TABLE 2

Organosols

| Example | Organosol Compositions (% w/w) | Visual Observation |
|---|---|---|
| Comparative Example B | LMA/HEMA-TMI//MMA/EA (97/3–4.7//25/75) | Liquid |
| Example 3 | ODA/HEMA-TMI//MMA/EA (97/3–4.7//25/75) | Solid (m.p. 48° C.) |
| Example 4 | BHA/HEMA-TMI//MMA/EA (97/3–4.7//25/75) | Solid (m.p. 60° C.) |
| Example 5 | BHA/HEMA-TMI//BHA/MMA/EA (97/3–4.7//20/20/60) | Solid (m.p. 60° C.) |
| Example 6 | Silicone Wax-TMI/MMA/EA | Solid (m.p. 68° C.) |

F. Preparation of Phase Change Developers

Example 7

This is a black phase change developer with an organosol/pigment ratio of 4 using organosol Example 3. Example 3

(169 g at 17% (w/w) solids in Norpar™12) was combined with additional 119 g of Norpar™12, 7.2 g of Monarch 120 carbon black (Cabot Corp., Billerica, Mass.) and 4.39 g of 6.15% Zirconium HEX-CEM solution (OMG Chemical Company, Cleveland, Ohio) in an 8 ounce glass jar. This mixture was then milled in a 0.5 liter vertical bead ml (Model 6TSG-¼, Amex Co., Ltd., Tokyo, Japan) charged with 390 g of 1.3 mm diameter glass beads (Potter Industries, Inc., Parsippany, N.J.). The mill was operated at 2,000 RPM for 1.5 hours without cooling water circulating through the cooling jacket of the milling chamber.

Examples 8–13

Examples 8–12 can be prepared accordingly by the above-mentioned method for Example 7 by replacing Example 3 and Norpar™12 by Example 4 and the corresponding carrier as listed in Table 3 below.

TABLE 3

Phase Change Developers

| Example | Organosol | Carrier |
|---|---|---|
| 7 | Example 3 | Norpar ™ 12 |
| 8 | Example 4 | Norpar ™ 12 |
| 9 | Example 4 | Octadecane ($C_{18}$) (Alfa Aesar/Johnson Matthey) |
| 10 | Example 4 | Eicosane ($C_{22}$) (Alfa Aesar/Johnson Matthey) |
| 11 | Example 4 | Pentacosane ($C_{25}$) (Alfa Aesar/Johnson Matthey) |
| 12 | Example 4 | Microcrystalline Wax W-445 (Witco) |
| 13 | Example 4 | Polyolefin Wax Epolene N-11 (Eastman) |

What is claimed is:

1. A solid phase change developer comprising:

(a) a carrier having a Kauri-butanol number less than 30; and (b) an organosol comprising a graft (co)polymeric steric stabilizer covalently bonded to a thermoplastic (co) polymeric core, said thermoplastic (co)polymeric core is insoluble in said carrier, and said (co)polymeric steric stabilizer comprising a crystallizing polymeric moiety that independently and reversibly crystallizes at or above 30° C., wherein said phase change developer has an activation point at or above 22° C.

2. The phase change developer of claim 1 wherein said crystallizing polymeric moiety is a polymeric side-chain covalently bonded to said (co)polymeric steric stabilizer.

3. The phase change developer of claim 1 wherein said crystallizing polymeric moiety is a polymeric main-chain covalently bonded to said (co)polymeric steric stabilizer.

4. The phase change developer of claim 1 further comprises at least one colorant.

5. The phase change developer of claim 1 wherein said crystallizing polymeric moiety is derived from a polymerizable monomer selected form the group consisting of hexacontanyl (meth)acrylate, pentacosanyl (meth)acrylate, behenyl (meth)acrylate, octadecyl (meth)acrylate, hexyldecyl acrylate, tetradecyl acrylate, and amino functional silicones.

6. The phase change developer of claim 2 wherein said developer further comprises at least one colorant.

7. The phase change developer of claim 2 wherein said crystallizing polymeric moiety is derived from a polymerizable monomer selected form the group consisting of hexacontanyl (meth)acrylate, pentacosanyl (meth)acrylate, behenyl (meth)acrylate, octadecyl (meth)acrylate, hexyldecyl acrylate, tetradecyl acrylate, and amino functional silicones.

8. The phase change developer of claim 1 wherein the phase change developer has an activation point between about 30° C. and 80° C.

9. The phase change developer of claim 1 wherein a colorant is physically associated with the thermoplastic (co)polymeric core.

10. A method for electrophotographic imaging comprising:

forming a patterned distribution of charge as an image;

heating the phase change developer of claim 1; and allowing developer activated by the heating to distribute over the patterned distribution of charge as a step in developing the image.

11. The method of claim 10 wherein developer distributed over the patterned distribution of charge is transferred to a receptor surface.

12. The method of claim 11 wherein after the developer is transferred to a receptor surface, heat and/or pressure fixes the developer to the receptor surface.

13. The phase change developer of claim 1 wherein the developer is in the form of a developer stick.

14. The phase change developer of claim 1 having a melting point between 22° C. and 40° C.

15. The method of claim 10 wherein the developer is in the form of a developer stick.

16. The method of claim 15 wherein the developer has a melting point between 22° C. and 40° C.

17. A phase change developer comprising:

(c) a carrier having a Kauri-butanol number less than 30; and (d) an organosol comprising a graft (co)polymeric steric stabilizer covalently bonded to a thermoplastic (co) polymeric core, said thermoplastic (co)polymeric core is insoluble in said carrier, and said (co)polymeric steric stabilizer comprising a crystallizing polymeric moiety that independently and reversibly crystallizes at or above 30° C.

wherein said phase change developer has an activation point at or above 22° C.

* * * * *